United States Patent [19]

Bengtsson

[11] 4,356,856

[45] Nov. 2, 1982

[54] DOOR HEAD GASKET FOR OVERHEAD DOORS AND THE LIKE

[76] Inventor: Fred B. Bengtsson, Kyrkås trappor 3, S-433 00 Partille, Sweden

[21] Appl. No.: 65,545

[22] Filed: Aug. 10, 1979

[30] Foreign Application Priority Data

Apr. 4, 1979 [SE] Sweden ..... 7902991

[51] Int. Cl.[3] ..... E05D 15/00

[52] U.S. Cl. ..... 160/209; 49/483

[58] Field of Search ..... 160/133, 201, 209, 185, 160/203, 40; 49/197, 496, 491, 488, 489, 483

[56] References Cited

U.S. PATENT DOCUMENTS

| | | | |
|---|---|---|---|
| 2,718,677 | 9/1955 | Cornell | 49/499 X |
| 2,837,151 | 6/1958 | Stroup | 160/201 X |
| 2,976,584 | 3/1961 | Ghormley | 49/483 X |
| 3,198,242 | 8/1965 | Crosswell | 160/209 |
| 3,511,301 | 5/1970 | Graham et al. | 160/209 |
| 3,640,322 | 2/1972 | Luby et al. | 160/133 |
| 4,156,448 | 5/1979 | Bengtsson | 160/201 |
| 4,250,941 | 2/1981 | McNalley | 49/477 |

*Primary Examiner*—Price C. Faw, Jr.

[57] ABSTRACT

The invention relates to doors of the kind, which are movable in guides mounted in opposing vertical edges of a doorway, the gasket being intended in the closed condition of the door to bridge the distance between the upper edge portion of the shutter blade and the wall side, along which the shutter blade is displaceable. The door head gasket comprises a stiff ledge (10) extending freely between the edges of the shutter blade, a band (16) of flexible material extending between the fastening points, one longitudinal edge of said band being connected with the ledge, whereas its other longitudinal edge is connected with the door head portion, whereby a seal between the shutter blade and the wall side is maintained independently of the extension of the shutter blade between its guides.

5 Claims, 6 Drawing Figures

DOOR HEAD GASKET FOR OVERHEAD DOORS AND THE LIKE

BACKGROUND OF THE INVENTION

The present invention relates to a door head gasket for overhead doors and the like. Such an overhead door usually has guides mounted in opposing vertical edges of a doorway, in which guides door panels are movable. The gasket serves the purpose in the closed position of the door to bridge the distance between the upper edge portion of the door panels and the one side of the wall, along which the shutter blade is displaceable.

Such doors often have a laminated design, i.e. they are provided with an outer layer of metal and an intermediate layer of insulating material such as for example plastic foam. Doors of the kind in question usually move along in guides provided on the inside of the opposing vertical lateral walls of the doorway. This means that the door in the closed condition must have a tight fit to the inside of the wall. Because of the fact that as a rule the same temperature as the one prevailing outside of the door does not prevail on its inside, differences due to longitudinal changes of one surface layer of the door relative to its other surface layer do arise, which result in a bulging of the upper edge of the door. This results in that problems with regard to the tightening fit between the upper edge portion of the door panel and the portion of the wall of the building located above the doorway can arise.

SUMMARY OF THE INVENTION

It is a principal object of the invention to provide a seal, which permits quite considerable movements of the upper edge portion of the door panel at right angles to the opening plane without the efficiency of the seal being impaired.

This object is attained by means of a door head gasket of the kind mentioned, which is substantially characterized by comprising a free stiff ledge extending between the guides of the door panel, which ledge is fitted in place near to the outer edges of the door panels, a band of flexible material extending between the points of attachment, one longitudinal edge of the band being connected with the ledge, its other longitudinal edge being connected with the upper edge portion of the door, whereby a seal between the door panel and the wall side is maintained independently of the extension of the door panel between its guided edges.

BRIEF DESCRIPTION OF THE DRAWINGS

An example of embodiment of the invention will now be described, reference being made to the accompanying drawings, in which.

DESCRIPTION OF A PREFERRED EMBODIMENT

Figure 1:
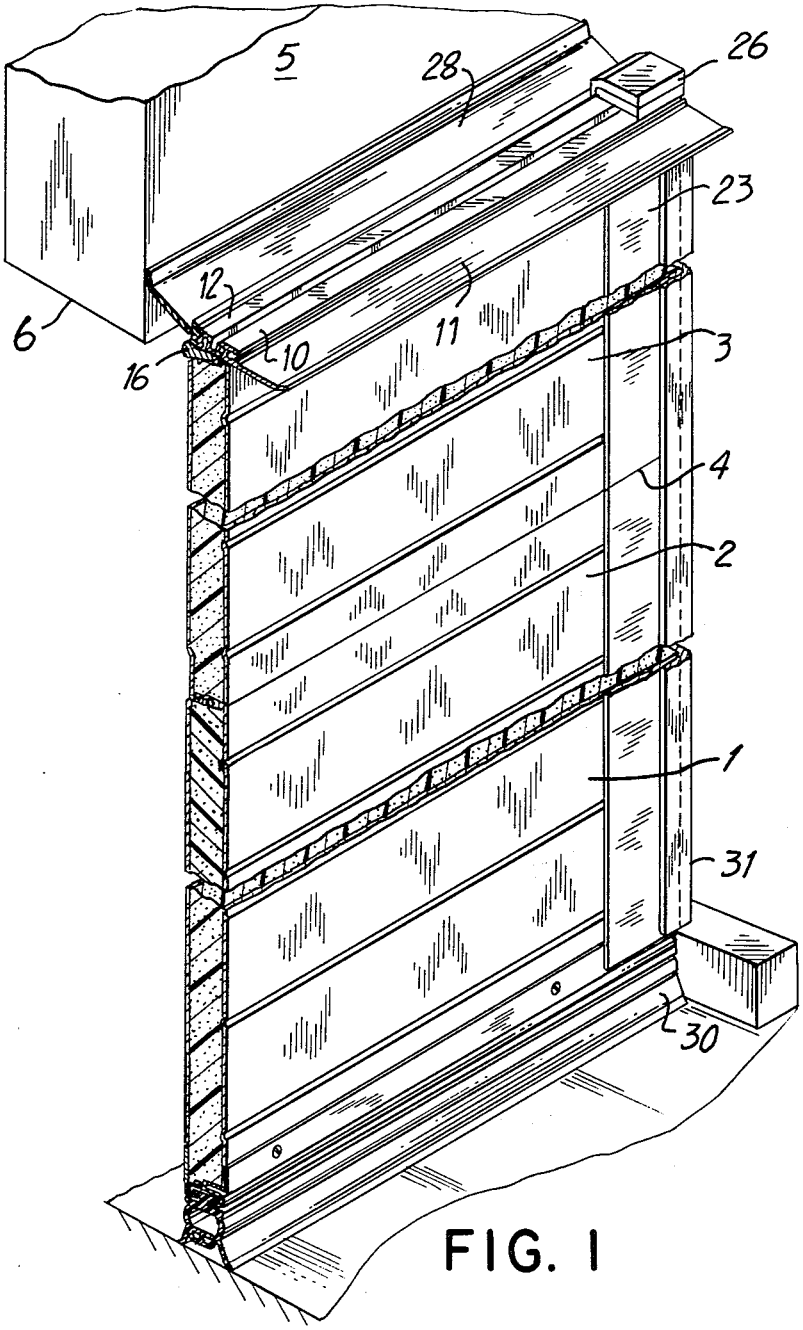
FIG. 1 is a sectional perspective view of a door panel provided with a gasket according to the invention and seen from the inside of the door.
Figure 3A:
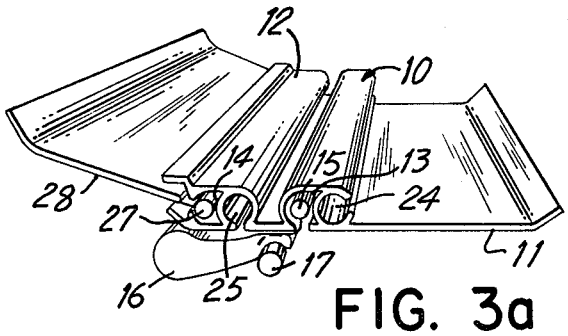
FIG. 3*a* is an enlarged perspective view of the details of FIG. 3.
Figure 2:
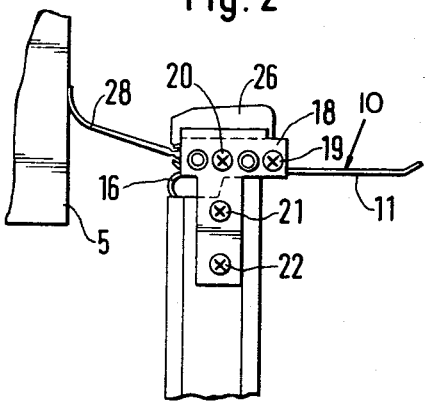
FIG. 2 is an end view of the upper edge portion of the door panel provided with the gasket.

The door illustrated in the drawings is divided up into a number of horizontal sections 1, 2 and 3, which are coupled together by means of horizontal hinges 4 in a known manner. In the drawing the door is shown in closed condition, i.e. the door panels 1–3 cover an opening 6 made in the wall of a building. The door is installed on the inside of this wall and is displaceable along the wall and along the opening plane. At its opposing vertical edges the door moves in known guides 31. The individual door sections have inner and outer surface layers 7 and 8 respectively, which are kept together by means of an insulating layer 9. The surface layer is usually made of metal and the insulating layer is made of a comparatively stiff foam type material. A sliding ledge resting against the upper edge side of the door is indicated by 10 and in the illustrated embodiment is made by means of an extrusion. The sliding ledge has a plane underside 11. In a bulging section 12 there is an undercut groove 13, which is open on the underside of said sliding ledge, and in the longitudinal edge portion there is an undercut groove 14, which is open in a direction towards the wall 5. A somewhat thicker edge portion 15 of a flexible band 16 is inserted into the groove 13, said band with another thick edge portion 17 being inserted into a corresponding undercut groove in the upper door section 3. Thus, the band 16 in its crosswise direction extends in a loop between the sliding ledge 10 and the door section 3. At each one of its ends, i.e. at the vertical lateral edges of the door panel, the sliding ledge 10 is attached to the upper door section by means of plate shaped fastening fittings 18, which by means of screws 19 and 20 are screwed on to the sliding ledge and which by means of screws 21 and 22 are screwed on to the edge linings 23 of the upper door section, said linings being formed by chute shaped rails, the lateral flanges of which extend in a direction above the door section along its plane sides. Longitudinal grooves 24 and 25 are made in the sliding ledge for the fastening of the screws 19 and 20 in the same, said grooves being open on one of its sides. The sliding ledge 10 moreover at each one of its ends supports a buffer body 26, which forms a stop in the raised condition of the door. A somewhat thicker edge portion 27 of a sealing ledge 28 engages the undercut groove 14, the portion of said sealing ledge located nearest to the sliding ledge 10 being comparatively stiff, whereas the outer portion 28*a* of said sealing ledge is comparatively flexible, in order to be easily adaptable to the shape of the wall 5. Because of the fact that the sliding ledge 10 is attached to the door panel at its extreme ends only, said sliding ledge can slide freely against the upper door section 3, when this door section bulges in a direction away from and towards the wall 5 due to varying differences of temperature between the outside and the inside of the door panel. Thus, the sliding ledge 10 maintains its straightness and efficiently seals against the wall independently of the movements of the door panel as a consequence of variations of temperature. Thanks to the flexible band 16 an efficient sealing effect is moreover maintained between the sliding ledge 10 and the door panel.

Figure 4:
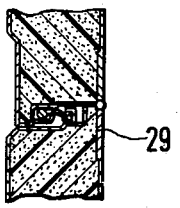
FIG. 4 shows a vertical cross-section through juxtapositioned edge portions of two connected door sections.
Figure 3:
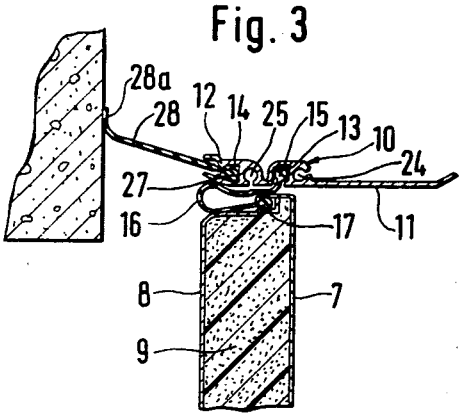
FIG. 3 is a view of a vertical cross-section through the same edge portion of the door panel.
Figure 5:
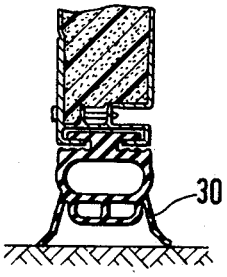
FIG. 5 is a view of a vertical cross-section through the lower edge portion of the bottom door section with a lower sealing ledge.

The portion of the two door sections 2 and 3 occupying a position around the hinged point 4 is shown in FIG. 4, a hinge fitting on the inside of the door being indicated by 29. A bottom gasket 30 mounted at the lower edge of the bottom section of the door is shown in FIG. 5. Because of the fact that the invention does neither depend on the hinge 4 nor on the bottom gasket, said means are not described more in detail.

The invention is not limited to the embodiment described above and illustrated in the drawings by way of example only, but can be varied as to its details within the scope of the following claims without therefore departing from the fundamental idea of the invention. The door head gasket can of course also be applied in connection with other types of doors, where the door panel serves the purpose of sealing against the side of the wall, along which the door panel is displaceable.

I claim:

1. Door head gasket for an overhead type door and the like, wherein said door has guides mounted in opposing vertical edges of a doorway (6), and door panels having outer edges movable in said guides, which gasket serves the purpose in the closed position of the door to bridge the distance between an upper edge portion of a door panel and a wall along which the door panel is displaceable, said gasket being characterized by, comprising a free stiff ledge (10) extending between the guides of the door panels, said ledge being attached to said upper edge portion of the door panel only near to the outer edges of the door panels, a band (16) of flexible material extending between points of attachment, one longitudinal edge of said band being connected with the ledge, and the other longitudinal edge of the band being connected with the upper edge portion of said door panel, whereby the ledge will follow the door panel in its movement and a seal between the door panel and the ledge is maintained independently of the extension of the door panel between its guided edges, and a flexible sealing ledge (28) supported by said ledge (10) having an edge portion **(28*a*) thereof, in the closed condition of the door, abutting against the wall (5)**.

2. Door head gasket according to claim 1, characterized by, the ledge (10) having a comparatively large extension in the thickness-direction of the door, so that the ledge covers the upper edge side of the door independently of possible changes of position as measured at right angles to the opening plane of the portion of the door positioned between the guides.

3. Door head gasket according to claim 2, characterized by, the ledge (10) comprising a section with a longitudinal undercut groove (13), said band having a somewhat thickened edge portion (15) received in the groove.

4. Door head gasket according to claim 3, characterized by, the ledge (10) having in its ledge portion facing the wall a longitudinal undercut groove (14), said flexible sealing ledge (28) having a somewhat thickened edge portion (27) received in said last named groove (14).

5. Door head gasket according to any one of the preceding claims, characterized by, the free stiff ledge (10) adjacent its ends having buffer stops (26), which form stop dogs to limit opening of the door panel.

* * * * *